US006116425A

United States Patent [19]

Frayer, Sr.

[11] Patent Number: 6,116,425

[45] Date of Patent: Sep. 12, 2000

[54] SORTING TRAY

[76] Inventor: Richard A. Frayer, Sr., 3883 Richlawn Rd., Richfield, Ohio 44286

[21] Appl. No.: 08/880,961

[22] Filed: Jun. 23, 1997

[51] Int. Cl.[7] ..... B65D 1/00

[52] U.S. Cl. ..... 206/557; 206/822

[58] Field of Search ..... 206/557, 559, 206/566, 567, 0.8, 0.815, 525, 804, 822; 229/904

[56] References Cited

U.S. PATENT DOCUMENTS

| | | | |
|---|---|---|---|
| 522,310 | 7/1894 | Armitage . | |
| 961,832 | 6/1910 | Ayres, Jr. . | |
| 1,780,819 | 11/1930 | Godefroid . | |
| 2,554,624 | 5/1951 | Lorentzen | 226/2 |
| 2,941,342 | 6/1960 | Allen | 53/154 |
| 2,952,369 | 9/1960 | Rew | 206/557 X |
| 3,255,570 | 6/1966 | Weimer | 53/390 |
| 3,819,064 | 6/1974 | Chandler | 214/1 C |
| 4,341,300 | 7/1982 | Roy | 206/566 X |

*Primary Examiner*—Jacob K. Ackun
*Attorney, Agent, or Firm*—Reese Taylor

[57] ABSTRACT

A sorting tray (10) includes a substantially planar sorting surface (12) bounded by an upwardly- and outwardly-extending sidewall (14). The sorting surface (12) includes a sorting portion (20) and a nozzle portion (22). The nozzle portion (22) necks down into a spout (16) that extends through the sidewall (14). The spout (16) is offset from the centerline (60) of the sorting surface (12) such that the spout (16) is offset. A flange (44) extends outwardly and downwardly from the top of the sidewall and presents a pair of measuring devices (50,52) and a hanger (46). The sorting tray (10) is particularly useful for assisting a person in sorting numerous differently-sized small objects, such as hardware.

5 Claims, 1 Drawing Sheet

SORTING TRAY

FIELD OF THE INVENTION

This invention relates to a device used to aid the manual sorting and packaging of various objects. More specifically, the present invention relates to a sorting tray in which various objects may be easily sorted and an offset spout through which the objects may be poured from the tray.

BACKGROUND OF THE INVENTION

In numerous home workshops throughout the country, handymen store miscellaneous hardware in cans, jars, or other similar containers. When the handyman needs a particular piece of hardware, he must take the time to clear a space in his workroom and dump the hardware out of the receptacle onto a clean, flat surface where it may be quickly sorted through until the desired piece is found. Such a practice is somewhat undesirable due to the time required to clear a space to accomplish this task. Thus, it is desirable to provide a portable, storable sorting space to accomplish this task.

In addition, once the hardware has been dumped onto the surface and the desired piece found, the handyman must then pick up all of the pieces and return them to the receptacle or scrape them over the edge of the surface while trying to catch them in the receptacle. Both of these practices are somewhat frustrating to a person who is involved with another project from which he does not wish to divert time.

Numerous storage containers are known in the art that include a plurality of drawers that store sorted hardware. However, few of these storage containers provide an easy method or location for sorting the hardware to be stored therein. Of course, one could always transport the entire storage container to a work site and sort hardware into the container as one works. However, this rarely occurs due to the time required to accomplish the sorting and the often-required need to clean or de-grease hardware before it is stored. Thus, the more frequent occurrence is that a person uses one or two containers to collect various hardware, but does not sort it for some time thereafter, if ever. At such a time, the portable sorting surface is particularly useful.

Another need for a portable sorting device arises when a storage container holds a particular item, but in numerous different sizes. In this situation, the handyman must dig through the container, hoping to correctly locate the desired size item or dump the entire contents out and look through it while it is spread out and easy to see. In this situation, the handyman also confronts the problem of where to dump the contents and how to easily return the contents back into the storage container. Thus, a need exists for a portable sorting device that includes means for easily returning hardware or other small objects into a storage container having a relatively narrow opening.

SUMMARY OF THE INVENTION

It accordingly becomes a principal object of the present invention to provide a sorting tray which serves as a portable sorting surface and having a spout for pouring objects out of the tray.

To that end, it has been found that a sorting tray may include a substantially planar sorting surface; a sidewall extending upwardly from the periphery of the sorting surface; and a spout attached to the sidewall.

Accordingly, a sorting tray of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
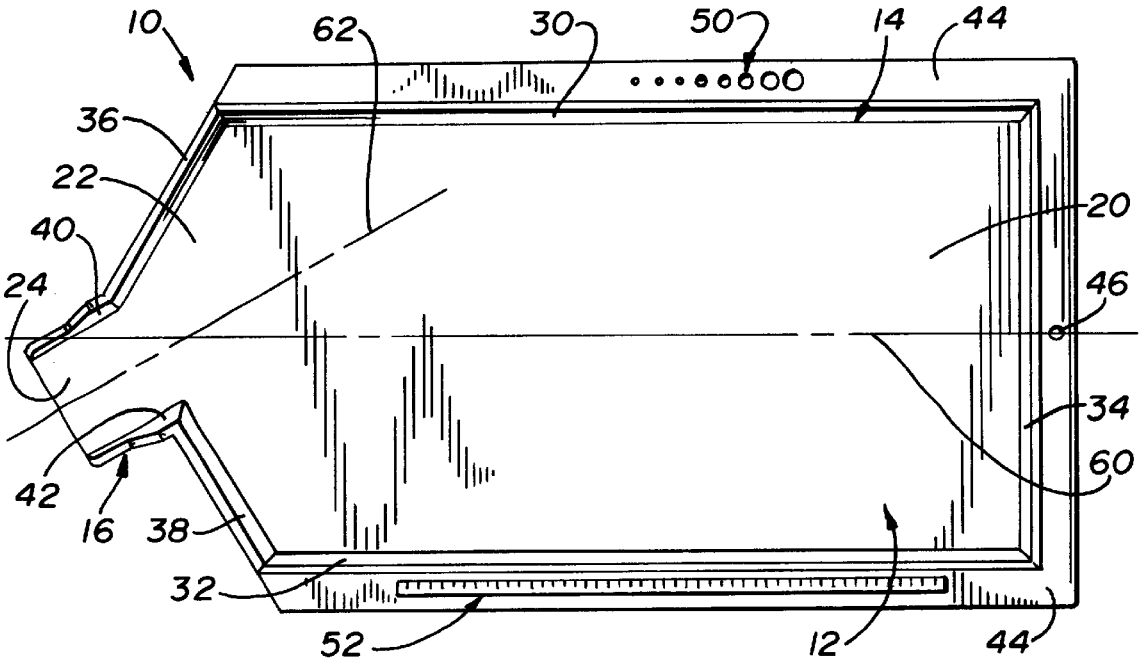
FIG. 1 is a plan view of the sorting tray made in accordance with the concepts of the present invention.
Figure 2:
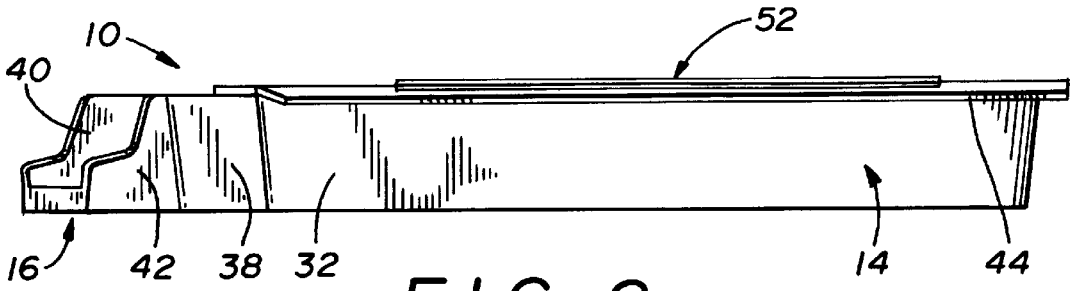
FIG. 2 is a side elevational view of the sorting tray.
Figure 3:
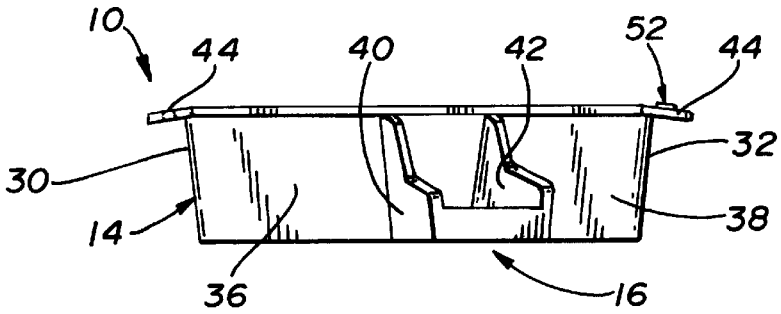
FIG. 3 is an end elevational view of the sorting tray.

A sorting tray, according to the concepts of the present invention, is indicated generally by the numeral 10 in the accompanying drawings. The sorting tray 10 generally includes a substantially planar sorting surface 12 that is substantially surrounded by a sidewall 14. The sidewall 14 is interrupted by a spout 16 that provides an opening through the sidewall 14 to the interior of the sorting tray 10 and the sorting surface 12.

The sorting surface 12 includes a generally large sorting portion 20 integrally connected to a nozzle portion 22. As may be seen in FIG. 1, the nozzle portion 22 of the sorting surface 12 is somewhat triangularly shaped such that it necks down into a bottom surface 24 of the spout 16. The particular geometry of the sorting portion 20 is not necessarily to be limited to the triangular shape disclosed in the drawings, as other shapes will also function within the concept of the present invention.

The sidewall 14 includes a pair of sidewalls 30,32 and an end wall 34 that border the sorting portion 20 of the sorting surface 12. The sidewall 14 further includes two nozzle walls 36,38 that border the nozzle portion 22 of the sorting surface 12. The sidewall 14 further includes two spout portions 40,42 that border the spout 16. All of these portions of the sidewall 14 extend upwardly from the sorting surface 12, and also outwardly therefrom to form a tapered sidewall. The tapered sidewall 14 makes it easier for the user to move or pick up small items from the corners where the sorting surface 12 and the sidewall 14 meet. The tapered sidewall 14 also makes it easier for the user to see into all of the corners of the sorting tray 10 while sorting various objects in the tray 10.

A flange 44 extends outwardly and downwardly from the upper surface of each of the sidewall portions 30,32 and the end portion 34 of the sidewall 14. The flange 44, in combination with the sidewall 14, provides a comfortable gripping arrangement whereby a user may grasp the sorting tray 10 and tilt or shake it with a great degree of control. By doing so, the user may easily rearrange the contents of the tray 10. The flange 44 also provides a convenient location for the connection of a hanger 46 that allows the sorting tray 10 to be hung on a wall. In the embodiment of the invention depicted in the drawings, the hanger 46 is disclosed as a through hole 46 that is disposed in the portion of the flange 44 adjacent the end wall 34. Of course, other hangers 46 may be used in combination with the flange 44 or the sidewall 14 to provide for easy storage of the sorting tray 10. Finally, the tapered nature of the flange permits ready nesting or stacking of a number of the trays for storage, shipment and display.

The flange 44 also provides convenient locations for measuring devices 50,52 that may be particularly useful for a person sorting hardware. In the embodiment of the invention depicted in the drawings, the measuring device 50 includes a plurality of differently-sized holes that each correspond to a different size bolt or screw size. These holes are disposed directly in the flange 44 and may be used to gauge bolts or screws that are being sorted in the sorting tray 10. The second measuring device 52 is depicted as being a standard ruler having either metric or English system markings thereon. The ruler 52 may be attached to the flange 44 by suitable means, such as adhesive, or may be directly formed in or on the flange 44. It is also contemplated that other types of measuring devices may be disposed on the flange 44 or the sidewall 14 or even the sorting surface 12 as may be desired by the handyman.

As may be perhaps best seen in FIG. 1, the sorting surface 12 has a generally longitudinal centerline 60 that substantially bisects the sorting portion 20 of the sorting surface 12. It may thus be seen that the centerline 62 is angularly offset with respect to the centerline 60. The offset spout 16 allows the user to pour objects from the sorting tray 10 more easily than a spout 16 that was in line with the centerline 60 of the sorting surface 12. The sorting tray 10 is typically to be used to pour items such as hardware into a container having a relatively narrow opening, such as a can or a jar. As such, the user of the sorting tray desires control over the pouring motion that must be undertaken to pour items from the tray 10. With the spout 16 in the offset position, the user can more readily see the objects as they are being poured from the sorting tray 10 and has more control over the motion. The offset position also somewhat decreases the torsional forces experienced by the user's wrist as he pours relatively heavy items from the sorting tray 10. The nozzle portion 22 of the sorting surface 12 causes the objects in the sorting tray 10 to be necked down into the spout 16 before they are dumped from the tray 10. The combination of the nozzle portion 22 with the offset spout 16 allows the user considerable control when pouring objects from the tray 10. Further, the overall length of the sorting portion 20 of the sorting surface 12 allows the user to divide the objects to be sorted into various groups and only pour one group at a time from the sorting tray 10. The user may accomplish this by using one hand to pour one group from the tray 10 while holding the other sorted groups with the other hand.

While a full and complete description of the invention is set forth in accordance with the dictates of the patent statutes, it should be understood that modifications can be resorted to without departing from the spirit hereof or the scope of the appended claims.

What is claimed is:

1. A sorting tray comprising:

a) a substantially planar sorting surface;

b) a sidewall extending upwardly from the periphery of said sorting surface; and c) a spout attached to said sidewall; wherein a first measuring device and a second measuring device are attached to said sidewall; wherein said first device includes a plurality of different-sized holes in said sidewall and said second device is a ruler.

2. A sorting tray according to claim 1, wherein said sorting surface has a centerline, said spout also having a centerline, said centerline of said spout being angularly disposed with respect to said centerline of said sorting surface.

3. A sorting tray, comprising:

a) a substantially planar sorting surface;

b) a sidewall extending upwardly from the periphery of said sorting surface;

c) a spout attached to said sidewall;

d) a first measuring device attached to said sidewall;

e) a second measuring device attached to said sidewall; and f) said first measuring device including a plurality of differently-sized holes in said sidewall and said second measuring device includes a ruler.

4. A sorting tray, comprising:

a) a substantially planar sorting surface having a nozzle portion and a sorting portion;

b) a sidewall extending upwardly and outwardly from the periphery of said sorting surface;

c) a flange extending outwardly and downwardly from said sidewall;

d) a spout connected to said sidewall and providing an opening therethrough;

e) a first measuring device carried by said flange;

f) a second measuring device carried by said flange; and g) said first measuring device includes a plurality of differently-sized holes through said flange and said second measuring device includes a ruler.

5. A sorting tray, comprising:

a) a substantially planer sorting surface having a nozzle portion and a sorting portion;

b) a sidewall extending upwardly and outwardly from the periphery of said sorting surface;

c) a flange extending outwardly and downwardly from said sidewall;

d) a spout connected to said sidewall and providing an opening therethrough; and e) said sorting surface has a centerline, said spout also having a centerline, said centerline of said spout being angularly disposed with respect to said centerline of said sorting surface.

* * * * *